US005249590A

United States Patent [19]

Jacobus et al.

[11] Patent Number: 5,249,590

[45] Date of Patent: Oct. 5, 1993

[54] ARTICLE RETAINING MECHANISM

[75] Inventors: Dwight W. Jacobus, Louisville; Joseph D. Tobbe, Taylorsville; Lawrence R. Collins, Louisville; James R. Cochrane, Louisville; Glen Miller, Louisville, all of Ky.

[73] Assignee: General Electric Company, Louisville, Ky.

[21] Appl. No.: 931,352

[22] Filed: Aug. 18, 1992

[51] Int. Cl.[5] ..... B08B 3/02

[52] U.S. Cl. ..... 134/135; 134/201; 211/41

[58] Field of Search ..... 134/142, 135, 201, 115 R, 134/137, 165, 166 R, 169 R, 172; 211/41

[56] References Cited

U.S. PATENT DOCUMENTS

| | | | |
|---|---|---|---|
| 2,078,699 | 4/1937 | Taylor et al. | 134/142 X |
| 2,708,037 | 5/1955 | Planeta | 211/41 X |
| 3,050,073 | 8/1962 | McMillan | 134/13 S |
| 3,451,556 | 6/1969 | Macoicz | 211/41 |
| 4,748,993 | 6/1988 | Llewellyn | 134/201 X |
| 4,909,401 | 3/1990 | McConnell | 211/41 |
| 4,927,033 | 5/1990 | Patera et al. | 211/41 |

FOREIGN PATENT DOCUMENTS

| | | | |
|---|---|---|---|
| 2039212 | 8/1980 | United Kingdom | 211/41 |

*Primary Examiner*—Frankie L. Stinson

*Attorney, Agent, or Firm*—Radford M. Reams; H. Neil Houser

[57] ABSTRACT

A mechanism for securing items in a dishwasher rack includes a support member mounted on the rack, and a U-shaped contact member with the distal ends of the contact member rotatably connected to the support member. A spring is mounted on the support member and engages the ends of the contact member to urge the contact member into engagement with items in the dishwasher rack.

20 Claims, 2 Drawing Sheets

FIG. 1
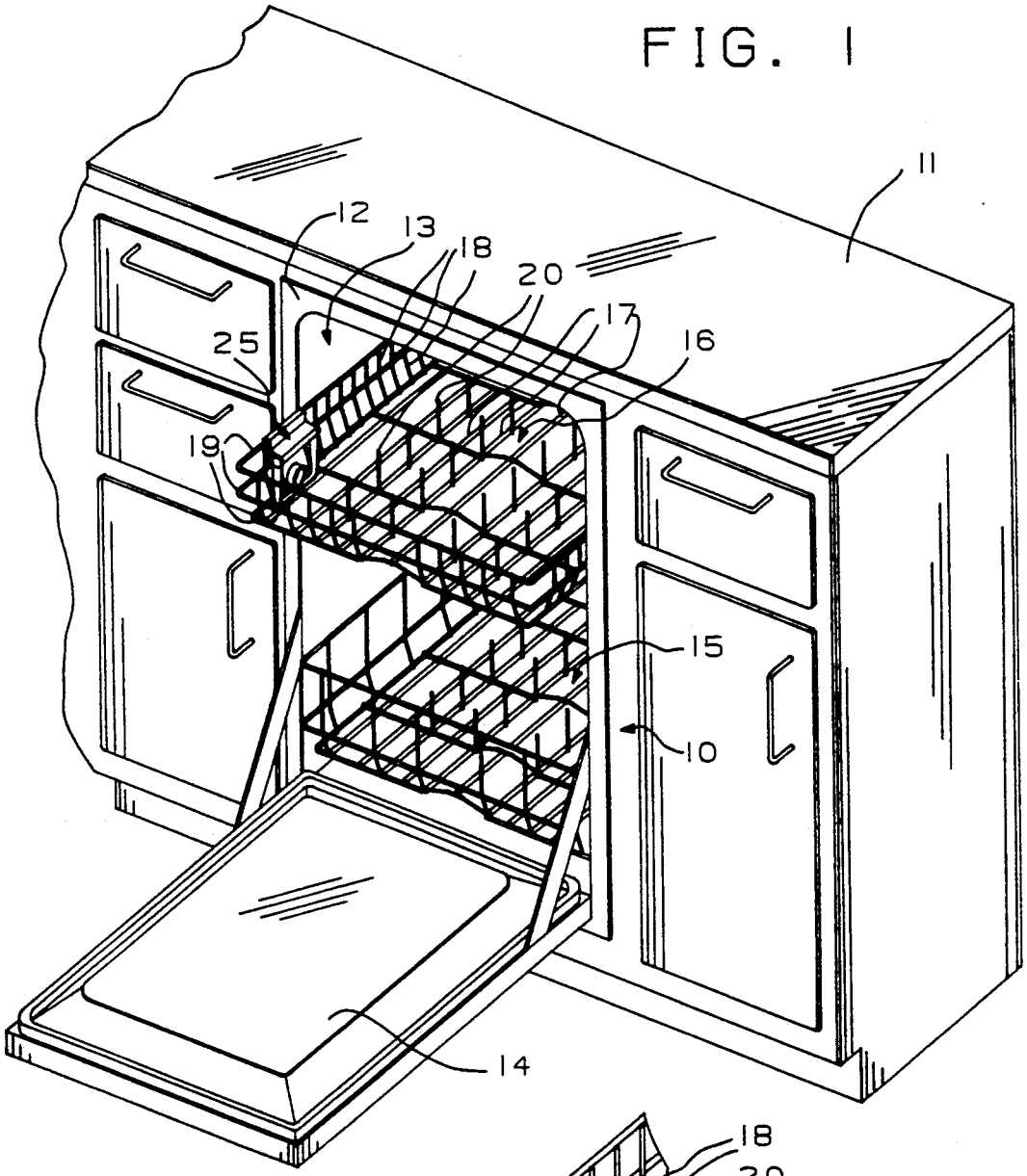
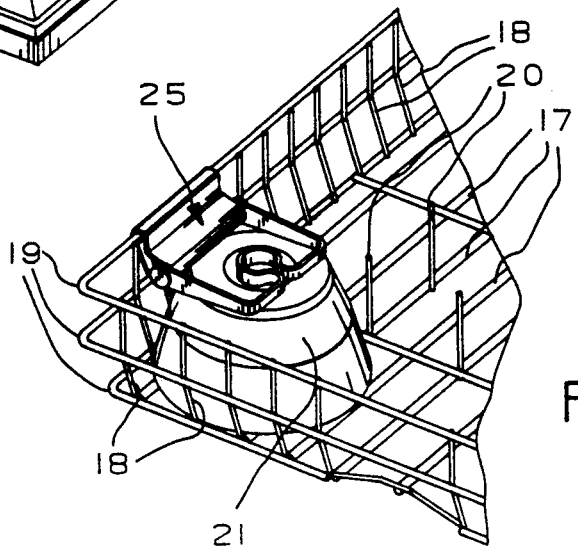
FIG. 2

ARTICLE RETAINING MECHANISM

FIELD OF THE INVENTION

This invention relates to automatic dishwashers and, more particularly, to a mechanism for retaining articles in an appropriate orientation in such dishwashers.

BACKGROUND OF THE INVENTION

Automatic domestic dishwashers, that is those designed for use in the home, support various articles in open trays or racks and accomplish the washing and rinsing action by spraying streams of water over the items. This action tends to upset light items, such as stemware and items made of light plastic materials. One result is that the items turn to orientations in which they collect pools of water and do not dry properly during the machine operation. Thus, the user must manually dry these items.

Numerous hold down devices have been suggested; however, none of them has proven to be optimal.

SUMMARY OF THE INVENTION

Therefore it is an object of this invention to provide an improved mechanism for retaining items in the desired orientation in automatic dishwashers.

Another object of this invention is to provide such a mechanism that is adaptable to resiliently secure articles of varying heights and configurations.

Still another object of this invention is to provide such a mechanism that occupies minimum space when not in use.

Yet another object is to provide such a mechanism which is removable from the dishwasher when not in use.

In accordance with one embodiment of the invention there is provided a mechanism for securing articles in a rack of an automatic dishwasher including a support member with a pair of spaced apart, stiffly resilient arms joined together at one end to form a pocket to receive a part of the rack. One of the arms includes a protrusion which projects toward the other arm to overlap the part of the rack in the pocket. The support member is formed with an elongated channel having a generally non-circular cross-sectional shape, with an enlarged base portion and a reduced width edge portion. A spring member has a pair of spaced apart, generally cylindrical wound spring portions joined together by an elongated portion which is laterally offset outside the cylindrical portions. The spring member is positioned in the channel with the cylindrical portions in the base portion of the channel and the elongated portion of the spring member in the edge portion of the channel. A transversely extending tab is formed at the distal end of each of the wound spring portions. A generally U-shaped contact member has a pair of spaced apart arms joined together by a bight portion. The distal end portion of each arm is bifurcated to form a recess. The distal end portions of the arms are received in the channel and the spring tabs fit in the recesses.

BRIEF DESCRIPTION OF THE DRAWINGS

The above and other objects, features and advantages of the present invention will become more apparent from the following detailed description, taken in conjunction with the accompanying drawings, in which:

FIG. 1 is a simplified, somewhat schematic, perspective view of an undercounter domestic dishwasher with the access door open to expose certain operating components and illustrating an article securing mechanism in accordance with one embodiment of the present invention;

FIG. 2 is a fragmentary perspective view of a portion of the upper dish rack of the machine of FIG. 1, but showing the article securing mechanism engaging a cup;

DETAILED DESCRIPTION OF THE PREFERRED EMBODIMENTS

Figure 3:
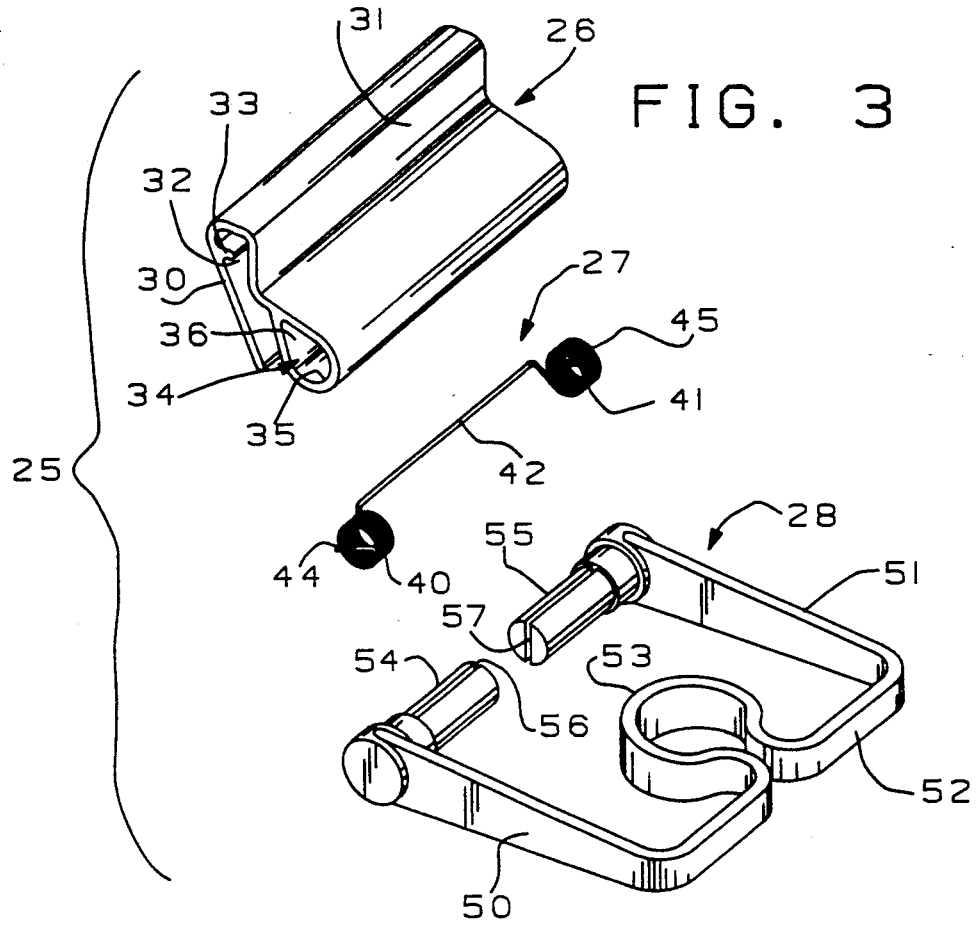
FIG. 3 is an exploded view of the article securing mechanism of FIG. 1.

Referring now to the drawings, and initially particularly to FIG. 1, there is illustrated a domestic automatic dishwasher 10 of the under-counter type installed in a typical kitchen cabinet 11. The dishwasher 10 includes a cabinet 12 defining a wash chamber 13. A door 14 is hinged along its bottom edge to move between a horizontal position, as shown, providing access to the chamber 13 and a vertical position in which it closes against the peripheral edge of the cabinet 12 to seal the chamber 13. Typically such dishwashers include a lower and an upper article supporting rack 15 and 16 respectively. These racks are movable out of the chamber 13 so that dishes, glasses, silverware, cooking utensils and other items to be washed may be loaded and unloaded. There are various other parts and components to such machines, all of which are well known in the art and have been omitted for the sake of simplicity.

The racks 15 and 16 have reticulated bases so that the water sprayed on the contents can easily drain to the bottom of the dishwasher. Conveniently, the racks are constructed as an open framework of metal rods or heavy gage wire which has been coated to protect the rack from rusting and glass items from contacting hard metal. For example top rack 16 includes a plurality of elongated spaced apart rods 17 forming its open bottom and a plurality of spaced apart rods 18 defining its sides. In addition three elongated rods or elements 19 are formed into open rectangles and support the side rods 18. The elements 19 are vertically spaced apart and extend generally parallel to the bottom of the rack. Finally article support structures like posts 20 extend up from the bottom rods 17. Articles to be washed in the top rack 16 are placed on the rack bottom defined by the rods 17 and loosely positioned in a generally vertical orientation by the posts 20 and the sides of the rack defined by rods 18 and elongated elements 19. It will be understood that the particular shape and arrangement of rods and elements is merely for illustrative purposes, as many such arrangements are well known in the art. Also, the racks may be constructed from materials other than coated metal, such as, for example, molded plastic.

Figure 4:
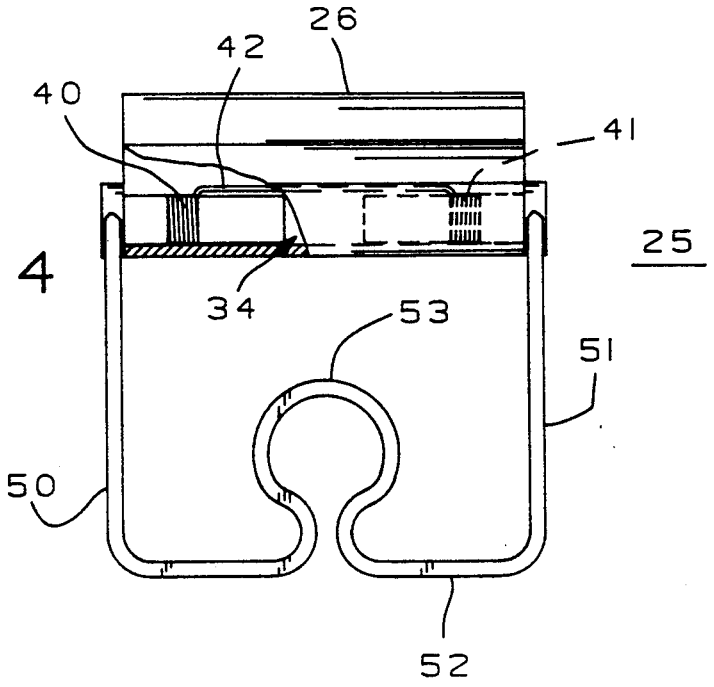
FIG. 4 is a front elevational view of the article securing mechanism, partly broken away for illustration.

Articles like stemware and glasses or containers made of light plastic, for example, are unstable and tend to be turned over by the force of the water sprayed about in the chamber 13 during washing and rinsing operations. According to this invention there is provided a new and improved mechanism for selectively and resiliently restraining items in the racks. An illustrative article securing mechanism 25 is shown in FIG. 1 in its rest position and in FIG. 2 resiliently securing a bowl or cup 21. Referring now more particularly to FIGS. 3 and 4, the mechanism 25 includes a support member 26, a spring member 27 and an article contact member 28.

The support member 26 is formed by a pair of spaced apart arms 30 and 31 which are joined at one end to define an elongated pocket 32. The arm 30 includes a protrusion in the form of an elongated rib 33 which extends along the width of arm 30 and projects into pocket 32. The mechanism 25 is mounted on a rack by inserting one of the rack members into the pocket 32. For example in FIGS. 1 and 2 the top elongated element 19 is positioned in the pocket. The arms 30 and 31 are made stiffly resilient so that they will flex to permit the mechanism 25 to be mounted on a rack while, at the same time providing a stable mounting. The rib 33 overlaps the rack element and assures that the mounting is secure. The support member arm 31 is formed with an elongated channel 34 extending across the full width of the arm. The channel 34 is non-circular in cross-sectional configuration, having a generally circular base portion 35 and a non-circular edge portion 36. The base portion 35 is enlarged relative to the edge portion or the edge portion is of a reduced width relative to the base portion for reasons to be discussed in detail hereinafter.

The spring member 27 includes a pair of spaced apart wound spring portions 40 and 41 respectively joined by an elongated portion 42. The wound spring portions are generally cylindrical in cross-section and the elongated portion 42 extends parallel to the axis of the portions 40 and 41 and is offset so as to lie laterally outside the circumference of the wound spring portions. Each wound spring portion is formed with the corresponding distal end of the spring bent into a tab, 44 and 45 respectively, lying transverse to the axis of the wound portion. The spring member is inserted into the channel 34 with the wound portions 40 and 41 received in the base 35 of the channel and the elongated spring portion 42 extending along the channel edge portion 36. In this manner the spring 27 is free to move slightly within the channel in an angular manner but is restrained from any appreciable rotation within the channel.

The contact member 28 is generally U-shaped, including a pair of spaced apart arms joined by an elongated bight portion 52. The bight 52 includes a loop 53 in its mid section. The distal ends of the arms 50 and 51 are formed as inwardly extending cylindrical portions or sections 54 and 55 respectively. The diameter of portions 54 and 55 corresponds to the diameter of the base portion 35 of channel 34 so that the sections are rotatably mounted in the channel. The cylindrical sections are bifurcated by slits 56 and 57 which form pockets to receive the tabs 44 and 45 formed adjacent the ends of spring 27.

The contact member 28 is attached to the support member 26 by inserting the cylindrical end portions 54 and 55 into corresponding ends of the channel 34 and with the tabs 44 and 45 of spring 27 received in the slits 56 and 57. The tabs are so positioned relative to the elongated spring portion 42 that the normal or rest position of the mechanism 25, when mounted on a rack, as shown in FIG. 1. That is the contact member extends substantially downward from the support member and the entire mechanism lies closely adjacent the side of the rack. When it is desired to restrain or to position an article, the contact member is rotated counter-clockwise (as seen in FIG's 1 and 2), the article is placed on the rack under the contact member and the member is allowed to descend into contact with the article (as illustrated in FIG. 2). The force of spring 27 keeps the contact member 28 in firm engagement with the article.

In addition, the bight portion of the central member 28 is sufficiently flexible to permit the stem of a piece of stemware to be inserted into the loop. Thus the contact members can secure the stemware even though the stemware is tall enough to stick above the contact member.

As will be evident from the foregoing description, certain aspects of the invention are not limited to the particular details of construction of the illustrative embodiment, and it is contemplated that various modifications may be made without departing from the true scope and spirit of the invention.

What we claim as new and desire to secure by Letters Patent of the United States is:

1. In an automatic dishwasher having a dish supporting rack with a reticulated base and at least one rod-like elongated element, spaced from and extending generally parallel to said base, an article securing mechanism comprising:

a support member releasably secured to the elongated rack element;

a generally U-shaped contact member having a pair of spaced apart arms with a bight portion therebetween, the distal end portions of said arms being rotatably supported from said support member; and spring means resiliently urging said contact member toward said reticulated base to releasably secure items to be washed which are placed between said reticulated base and said contact member.

2. The invention as set forth in claim 1, wherein: said support member includes at least one enclosed channel and said distal end portions of said arms are rotatably mounted in said at least one channel.

3. The invention as set forth in claim 1, wherein: said support member includes an elongated channel with a non-circular cross-sectional shape having an enlarged base portion and a reduced width edge portion; and said spring means includes a spring member having a pair of spaced apart cylindrical wound spring portions with an elongated portion therebetween, said elongated portion extending parallel to the axis of and offset outside the diameter of said cylindrical wound spring portions; said spring member is positioned in said channel with said wound spring portions positioned in said base portion and said elongated portion positioned in said reduced width edge portion of said channel.

4. The invention as set forth in claim 3, wherein: each of said wound spring portions includes a transversely extending tab and said distal end of each arm of said contact member is formed with a bifurcation receiving a corresponding one of said tabs.

5. The invention as set forth in claim 1, wherein: said support member comprises a pair of spaced apart, stiffly resilient arms joined at one end to form a pocket therebetween, with the at least one elongated member of said dish supporting rack received in said pocket.

6. The invention as set forth in claim 5, wherein one of said support member arms includes a tab projecting toward the other of said arms to overlap the at least one elongated member.

7. The invention as set forth in claim 1, wherein: said bight portion of said contact member includes a loop adapted to receive the stem of a stemware item to be washed.

8. A mechanism for releasably securing items in an automatic dishwasher, comprising:

a support member formed to mount on a dish supporting rack of a dishwasher;

a generally U-shaped contact member having a pair of arms with a bight portion therebetween, said arms including distal end portions rotatably connected to said support member;

spring means resiliently urging said contact member in a direction to engage items placed in the dishwasher rack.

9. A mechanism in accordance with claim 8, wherein: said support member includes at least one socket portion and said distal ends of said contact member arms are rotatably received in said at least one socket.

10. A mechanism in accordance with claim 8, further including: means to maintain the relative relationship between said spring member and each of said support and contact members.

11. A mechanism in accordance with claim 8, wherein: said support member includes an elongated channel; said spring means comprises a spring member having a pair of spaced apart wound spring portions with an elongated portion therebetween; and said spring member is mounted in said channel.

12. A mechanism in accordance with claim 11, wherein said channel and said spring member are configured to interact so as to restrain said spring member from significant rotation within said channel.

13. A mechanism in accordance with claim 11, wherein: said channel has a non-circular cross-sectional shape with an enlarged base portion and a reduced width edge portion; said wound spring portions are cylindrical in configuration and said elongated portion is disposed laterally outside said cylindrical wound spring portions; and said spring member is positioned in said channel with said cylindrical wound spring portions in said enlarged base and said elongated portion in said reduced width edge portion of said channel.

14. A mechanism in accordance with claim 11, wherein: said channel has a non-circular cross-sectional shape with an enlarged base portion and a reduced width edge portion; said wound spring portions are cylindrical in configuration and said elongated portion is disposed laterally outside said cylindrical wound spring portions; said spring member is positioned in said channel with said cylindrical wound spring portions in the enlarged base and said elongated portion in the reduced width edge portion of said channel; each of said cylindrical wound spring portions includes a transversely extending tab; said distal end portion of each of said contact member arms includes an aperture receiving a corresponding one of said tabs for concurrent movement thereof.

15. A mechanism in accordance with claim 8, wherein: said spring means is supported on said support member and said distal ends of said contact member arms have an interference fit with said spring means.

16. A mechanism in accordance with claim 15, wherein: said spring means includes a pair of spaced apart tabs and said distal end portion of each of said contact member arms includes an aperture receiving a corresponding one of said tabs for concurrent movement of said tabs and said contact member.

17. A mechanism in accordance with claim 8, wherein: said support member comprises a pair of spaced apart, stiffly resilient arms joined at one end to form a pocket therebetween to receive a part of the dishwasher rack.

18. A mechanism in accord with claim 17, wherein: one of said support member arms includes a projection positioned to overlap a part of a dishwasher rack when said mechanism is mounted on the rack.

19. The invention as set forth in claim 8, wherein: said bight portion of said contact member includes a loop to receive the stem of a stemware item placed in the dishwasher rack.

20. An mechanism for releasably securing items in an automatic dishwasher rack, comprising:

a support member formed with a pair of spaced apart, stiffly resilient arms joined together at one end to form a pocket to receive a part of the rack, one of said arms including a protrusion extending toward the other arm to overlap the part of a rack received in said pocket;

said support member including an elongated channel having a generally non-circular cross-sectional shape with an enlarged base portion and a reduced width edge portion,;

a spring member having a pair of generally cylindrical wound spring portions, an elongated portion extending between and positioned laterally outside said cylindrical portions, and a pair of spaced apart transverse tabs;

said spring member being positioned within said channel with said wound spring portions of said spring member in said base portion of said channel and said elongated portion of said spring member in said reduced width edge portion of said channel;

each of said wound spring portions including a transversely extending tab; and a generally U-shaped contact member having a pair of spaced apart arms with a bight portion therebetween, the distal end portions of said arms being received in said channel and including recesses receiving said spring tabs.

* * * * *